US006293211B1

(12) United States Patent
Samilo

(10) Patent No.: US 6,293,211 B1
(45) Date of Patent: Sep. 25, 2001

(54) METHOD AND APPARATUS FOR PRODUCING PATTERNED TUFTED GOODS

(75) Inventor: John S. Samilo, Ringgold, GA (US)

(73) Assignee: Tapistron International, Inc., Ringgold, GA (US)

( * ) Notice: Subject to any disclaimer, the term of this patent is extended or adjusted under 35 U.S.C. 154(b) by 0 days.

(21) Appl. No.: 09/502,914

(22) Filed: Feb. 11, 2000

Related U.S. Application Data

(63) Continuation-in-part of application No. 09/305,587, filed on May 5, 1999, now Pat. No. 6,202,580.

(51) Int. Cl.[7] ..... D05C 15/10; D05C 15/28; D05C 15/36

(52) U.S. Cl. ..... 112/80.16; 112/80.23; 112/80.3; 112/475.23

(58) Field of Search ..... 112/80.16, 80.23, 112/80.3, 80.31, 80.32, 80.42, 80.54, 80.55, 80.56, 80.57, 80.58, 80.59, 80.6, 80.72, 80.73, 80.05, 80.08, 475.23

(56) References Cited

U.S. PATENT DOCUMENTS 3,263,631 * 8/1966 Freeman ..... 112/80.16 X
3,585,948 * 6/1971 Cobble ..... 112/80.31
4,549,496 * 10/1985 Kile ..... 112/79.5
4,991,523 * 2/1991 Ingram ..... 112/80.05
5,080,028 * 1/1992 Ingram ..... 112/80.08
5,158,027 * 10/1992 Ingram ..... 112/80.08
5,165,352 * 11/1992 Ingram ..... 112/80.08
5,205,233 * 4/1993 Ingram ..... 112/80.16
5,267,520 * 12/1993 Ingram ..... 112/410
5,383,415 * 1/1995 Padgett, III ..... 112/80.73 X
5,544,605 * 8/1996 Frost ..... 112/475.23
5,588,383 * 12/1996 Davis et al. ..... 112/80.16
5,738,030 * 4/1998 Ok ..... 112/80.23 X
5,899,152 * 5/1999 Bardsley et al. ..... 112/80.73

* cited by examiner

*Primary Examiner*—Peter Nerbun
(74) *Attorney, Agent, or Firm*—Sutherland Asbill & Brennan, LLP

(57) ABSTRACT

Apparatus for producing pattern tufted goods, such as pattern tufted carpet, produces cut and loop pattern carpet using independent yarn colored pattern and cutting pattern process controllers, colored pattern carpet having differential pile heights, and colored pattern carpet with tight or loose tufts. In addition, an apparatus for making color patterned tufted carpet has a yarn cutting system which more reliably cuts yarn when cut tufts are desired.

43 Claims, 5 Drawing Sheets

METHOD AND APPARATUS FOR PRODUCING PATTERNED TUFTED GOODS

CROSS-REFERENCE TO RELATED APPLICATIONS

This application is a continuation-in-part of U.S. patent application Ser. No. 09/305,587 filed in the U.S. Patent and Trademark Office on May 5, 1999, U.S. Pat. No. 6,202,580, the disclosure of which application is expressly incorporated by reference herein in its entirety.

TECHNICAL FIELD

This invention relates generally to tufting apparatus for producing patterned textile goods such as carpet, upholstery, and the like, and more particularly to tufting apparatus for producing tufted goods having a multicolor pattern by selectively feeding different yarns to a row of reciprocating hollow needles which implant the yarns into a transversely shifting backing material. More particularly, this invention relates to such a tufting apparatus which can produce tufted goods with a variety of yarn color patterns and cut/loop patterns, tufted goods with patterns of differing pile heights, and tufted goods having tight or loose tufts.

BACKGROUND OF THE INVENTION

U.S. Pat. No. 4,549,496 to Kile discloses a tufting apparatus for producing patterned tufted goods using yams of different colors. This apparatus is capable of selectively implanting yams of different colors into a backing to produce a tufted product having a predetermined multicolored pattern. The patent apparatus employs multiple heads spaced across the width of a backing material. Each head comprises a hollow needle for penetrating the backing and implanting yarn tufts in the backing by reciprocating the head and feeding yarn through the needle pneumatically. This device uses a system of gears and rollers to select the desired yarn for implantation into the backing for each penetration by the needle. The multiple heads are stepped in synchronism across the backing for a distance corresponding to the spacing between the heads in order to implant a transverse row of yam tufts. This process is repeated as the backing is advanced to complete the product. A computer controls the selection of yarn implanted by each needle for each penetration of the backing in order to reproduce the desired pattern in the finished goods.

The apparatus disclosed in the Kile patent and its method of operation have been subsequently modified. Such modifications are disclosed in U.S. Pat. Nos. 4,991,523; 5,080,028; 5,165,352; 5,158,027; 5,205,233; and 5,267,520, all to Ingram., and U.S. Pat. No. 5,588,383 to Davis et al. These subsequent patents disclose an apparatus in which the backing is shifted transversely relative to the reciprocating needles while the backing advances through the apparatus. Thus, rather than the multiple heads which carry the hollow needles being moved across the backing, the subsequent patents disclose an apparatus wherein the backing rather than the heads is shifted transversely. In addition, the device disclosed in the Ingram patents comprises a plurality of hollow needles carried on a widthwise extending member. As the yarn is implanted by the reciprocating needles, the backing is shifted in the transverse direction by an amount corresponding to the spacing between adjacent needles in order to implant a transverse row of tufts. A knife blade is associated with each needle and positioned on the opposite of the backing for cutting the yarn at the lower position of the needle.

The apparatus disclosed in the Ingram patents further includes a mechanism for supplying continuous lengths of the different yarns to the needles comprising a system of gears. More specifically, this yarn supply mechanism includes a main rotatable gear shaft tied to and driven by the main drive shaft that reciprocates the needles. A plurality of small gears extending along the length of the main gear shaft are selectively engagable with the main gear shaft to feed the desired yarns to the needles. The individual gears for feeding the yarns are selectively shifted in and out of meshing cooperation with the main gear shaft by air solenoids. Once the yarn is fed by the gear system, the yarn is drawn to and out of the needle by pressurized air from a manifold mounted to the reciprocating needle mounting bar.

U.S. Pat. No. 5,080,028 discloses a mechanical system for retracting yarns from the needles when other yarns are desired to be implanted. The retraction mechanism includes a reciprocating plunger disposed between two yarn guides. The reciprocating plunger pulls the yarn to be retracted out of the needle and an independent pneumatic mechanism, such as an air solenoid, drives the reciprocating plunger. The reciprocating plunger operates in unison with the pneumatic mechanism which feeds the yarn to the needles.

Although the tufting apparatus disclosed in the Kile and Ingram patents performs well, there is a need for a tufting apparatus for producing patterned textile goods with increased throughput, increased reliability, and greater pattern variety.

SUMMARY OF THE INVENTION

This invention satisfies the foregoing need by providing a system for producing patterned tufted goods comprising independent control systems for a yarn supplier and a yarn cutting system. This allows for yarn color patterns and cut/loop patterns to be stored and implemented independently so that different colored yarn patterns can be used with different cut/loop patterns. More particularly, the apparatus of this invention comprises a tufting frame, a backing transport system mounted to the frame for advancing of backing in a direction past a yarn applying region, a yarn applicator disposed at the yarn applying region, a yarn supplier for supplying a plurality of continuous lengths of different yarns to the yarn applicator, a yarn cutting system for selectively cutting the yarn implanted in the backing, a first control system for controlling the yarn supplier, and a second control system independent of the first control system for controlling the yarn cutting system. The yarn applicator penetrates the backing and implants the yarn in the backing successively along a row during movement of the backing to form a plurality of yarn tufts in the backing. The first control system for controlling the yarn supplier does so in accordance with a color pattern so as to select which of the continuous lengths of yarn, if any, is implanted in the backing at each penetration of the yarn applicator. The second control system for controlling the yarn cutting system does so with a cut/loop pattern so as to selectively cut the yarn implanted in the backing to form a cut tuft or alternatively form a loop tuft, so that the tufted good has both cut tufts and loop tufts.

Desirably, the first control system for controlling the yarn supplier comprises a first programmable computer and the second control system for controlling the yarn cutting system comprises a second programmable computer independently programmable from the first computer. Although the first and second control systems are independently programmable, their operation is synchronized so that the yarn applicator and yarn cutting system are synchronized.

The yarn applicator desirably comprises a plurality of hollow tufting needles and the yarn cutting system desirably comprises a plurality of cutting elements for selectively engaging respective hollow tufting needles so as to cut the yarn in response to a signal from the second control system as the hollow tufting needles implant the yarn in the backing.

According to another aspect of the present invention, a method for producing patterned tufted carpet is provided comprising advancing the backing in a direction past the yarn applying region, supplying a plurality of continuous lengths of different yarns to a yarn applicator, penetrating the backing with a reciprocating yarn applicator, controlling the supplying of the yarn in accordance with a color pattern, and selectively cutting with a yarn cutter. The yarn is implanted in the backing at each penetration by engaging the yarn cutter with the yarn applicator before the yarn applicator begins an upstroke. The reciprocating yarn applicator implants yarn in the backing successively along a row during movement of the backing to form a plurality of yarn tufts in the backing and the yarn is supplied in accordance with a color pattern so as to select which of the continuous lengths of yarn, if any, is implanted in the backing at each penetration. By engaging the yarn cutter with the yarn applicator before the yarn applicator begins an upstroke, the yarn cutter more reliably cuts the yarn.

More particularly, according to this aspect of the present invention, the step of penetrating the backing with a yarn applicator includes reciprocating the yarn applicator between a top position and a bottom position such that each stroke of the yarn applicator includes a downstroke from the top position to the bottom position and an upstroke from the bottom position to the top position. The cutting step includes engaging the yarn cutter with the yarn applicator during a stroke of the yarn applicator after the yarn applicator penetrates the backing and before the yarn applicator begins an upstroke. Desirably, the cutting step includes engaging the yarn cutter with the yarn applicator during a stroke of the yarn applicator as the yarn applicator reaches the bottom position on the downstroke of the yarn applicator cycle. Preferably, the method includes generating a timing signal during the yarn applicator cycle and controlling the yarn cutter so that the yarn cutter engages the yarn applicator in response to the timing signal. The timing signal can be generated when the yarn applicator reaches the top position on the upstroke.

The yarn applicator desirably comprises a plurality of hollow tufting needles and the yarn cutter comprises a plurality of corresponding cutting elements. The method includes selectively engaging the cutting elements with respective hollow tufting needles. Specifically, the cutting step includes selectively reciprocating the cutting elements into engagement with the hollow tufting needles. For example, the cutting step can include selectively reciprocating the yarn cutter into engagement with the yarn applicator so that, in response to the timing signal, the yarn cutter moves toward yarn applicator as the yarn applicator is on the downstroke.

In particular, in accordance with this aspect of the present invention, the cutting step includes reciprocating the yarn cutter between a bottom position and a top position such that each stroke of the yarn cutter includes an upstroke from the bottom position to the top position and a downstroke from the top position to the bottom position. The timing signal is generated when the yarn applicator reaches the top position on the upstroke. The cutting step includes engaging the yarn cutter with the yarn applicator in response to the timing signal during a stroke of the yarn applicator as the yarn applicator reaches the bottom position on the downstroke of the yarn applicator cycle and the yarn cutter reaches the top position of the yarn cutter stroke.

Desirably, in making patterned tufted goods, the step of advancing the backing includes moving the backing transversely to the direction of advancement of the backing such that the yarn is implanted in the backing successively along a transverse row during transverse movement of the backing to form the plurality of yarn tufts.

According to another aspect to this invention, an apparatus for producing patterned tufted goods having different pile heights comprises a tufting frame, a backing transport system mounted to the tufting frame for advancing the backing in a direction past the yarn applying region, a yarn applicator disposed at the yarn applying region and mounted to the frame for penetrating the backing and implanting the yarn therein successively along a row during movement of the backing to form a plurality of yarn tufts in the backing, a first yarn supplier for supplying a continuous length of at least one yarn to the yarn applicator at a first linear rate so that tufts formed by the yarn supplied by the first yarn supplier has a first pile height, and a second yarn supplier for supplying a continuous length of at least one yarn to the yarn applicator at a second linear rate different than the first linear rate so that the tufts formed by the yarn supplied by the second yarn supplier has a second pile height different from the first pile height.

Desirably, according to this aspect of the present invention, the first yarn supplier is disposed along one side of the tufting frame and the second yam supplier is disposed along an opposite side of the frame. Desirably, the yarn applicator comprises a plurality of hollow tufting needles as well.

In particular, according to this aspect of the present invention, the first yarn supplier comprises a first gear drive shaft and a first motor capable of rotating the first gear drive shaft at a first speed and the second yarn supplier comprises a second gear drive shaft and a second motor capable of rotating the second gear drive shaft at a second speed different from the first speed.

This third embodiment of the invention produces tufted goods such as tufted carpet having a pattern of different pile heights on the same product.

According to a fourth aspect of this invention, a method for producing tufted goods is provided comprising advancing of backing in a direction past a yarn applying region, supplying a continuous length of yarn to a yarn applicator, and reciprocating a yarn applicator, which comprises a plurality of tufting needles, between a top position above the backing and a bottom position below the backing such that the hollow needles penetrate the backing and implant the yarn in the backing successively along a row during movement of the backing to form a plurality of yarn tufts in the backing. The hollow tufting needles travel a displacement distance on each stroke from the backing to the bottom position and back to the backing when forming a tuft, wherein a length of the yarn is supplied on each stroke of the applicator, the length of the yarn being different than the displacement distance. The length of yarn supplied on each stroke of the yarn applicator can be less than the displacement distance to produce tight tufts or can be greater than the displacement distance so that the tufts are loose.

Other objects, features and advantages of the present invention will become apparent from the following detailed description, drawings, and claims.

DETAILED DESCRIPTION OF DRAWINGS

The tufting apparatus shown in FIG. 1 includes a number of subsystems which will be identified briefly below and then described in more detail thereafter. First, the structure of the apparatus 10 will be described in detail followed by a detailed description of the operation of the tufting apparatus. Although the tufting apparatus is disclosed in detail hereinafter, some suitable subsystems of the tufting apparatus are disclosed in detail in U.S. Pat. No. 4,991,523; 5,080,028; 5,165,352; 5,158,027; 5,205,233; and 5,267,520, all to Ingram., and U.S. Pat. No. 5,588,383 to Davis et al., the disclosures of which U.S. Patents are hereby expressly incorporated herein by reference in their entirety.

STRUCTURE OF THE TUFTING APPARATUS

Figure 1:
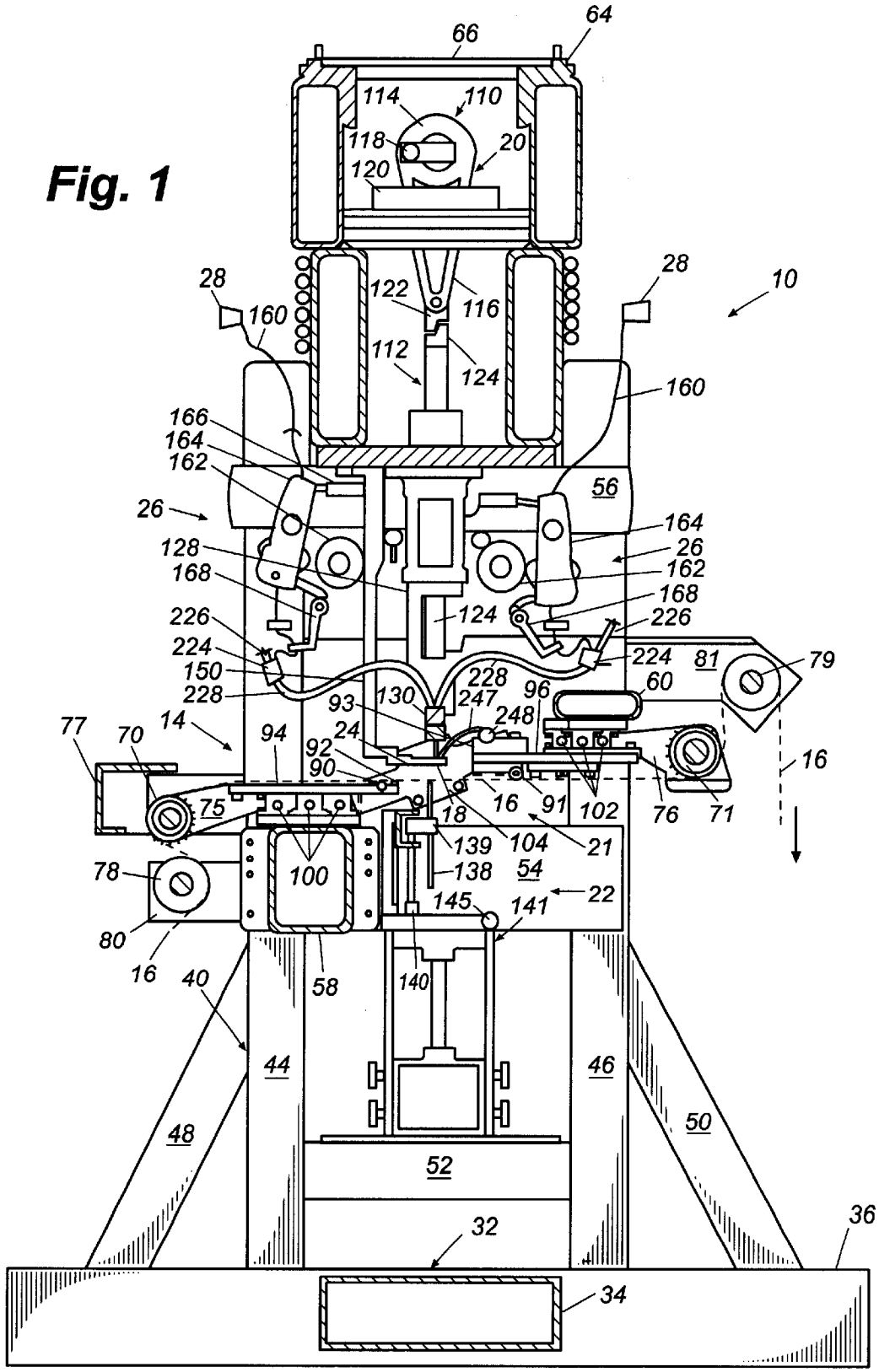
FIG. 1 is a partial sectional elevation view of a tufting apparatus made in accordance with an embodiment of the present invention.

Generally described, the tufting apparatus 10, which is best shown in FIG. 1 comprises a tufting frame 12 supporting a backing transport system 14 for directing a backing 16 through the tufting apparatus, a row of needles 18 mounted to a yarn applicator 20 for implanting tufts of yarn in the backing at a yarn applying region 21, a yarn cutting system 22 for cutting the yarn as it is implanted, presser feet 24, a yarn feed mechanism 26 for supplying continuous lengths of yarn from a yarn supply 28, such as a creel (not shown) to the needles, and a control system 30 for controlling the operation of the tufting apparatus so as to produce a patterned tufted product in accordance with a preselected pattern.

The term "tuft," as used herein, encompasses both cut yarn stitches and loop yarn stitches, and the term "tufting" encompasses both the act of forming a cut yarn stitch and the act of forming a loop yarn stitch.

The length of the tufting apparatus 10, the spacing of the needles 18, and the number of needles in the apparatus can vary considerably depending on the product to be produced and the desired rate of production.

The Frame

The frame 12 of the tufting apparatus 10 is shown in FIG. 1 and comprises a horizontal I-shaped base frame 32 which includes an elongate member 34 extending perpendicularly between end members 36. Vertical end frames 40 extend upwardly from the end members 36. Each of the end frames 40 comprises a pair of spaced vertical members 44 and 46, angled support bars 48 and 50 extending between the vertical members and the respective end members 36. In each of the end frames 40, a cutter system frame support bar 52, a backing frame support bar 54, and an upper frame support bar 56 are spaced from one another and extend between the vertical members 36. A transverse backing support beam 58 extends between the vertical end frames 40 proximate the backing inlet side 59 of the tufting apparatus 10. Another transverse support beam 60 extends between the vertical end frames 40 at the exit side 61 of the tufting apparatus 10. Respective end panels 62 extend between the spaced vertical members 44 and 46 and between the backing frame and upper frame support bars 54 and 56 for supporting various components as described hereinbelow. A plurality of spaced vertical support bars (not shown) extend vertically between the transverse support beam 60 and elongate main drive housing 64. The main drive housing 64 extends between the vertical end frames 40 and is mounted on top of the upper frame support bars 56.

The interior of the main drive housing 64 is accessible through removable access panels 66 on top of the main drive housing.

The Backing Transport System

The backing transport system 14 transports the backing 16 through the tufting apparatus 10 while the reciprocating hollow needles 18 implant tufts of yarn in the backing at the yarn applying region 21. The backing may be in the form of a continuous running web. The backing 16 is moving in the direction of the arrow in FIG. 1 and the area through which the backing passes through the tufting apparatus 10 is the yam applying region 21.

As shown in FIG. 1, the backing transport system 14 comprises an entry pin roller 70 and an exit pin roller 71 which are driven by respective electric motors (not shown). The motors maintain the backing 16 under tension as the backing passes the reciprocating needles 18. The exit pin roller motor controls the tension of the backing 16 and the entry pin roller motor controls the velocity of the backing. The pin rollers 70 and 71 are mounted to the frame 12 and extend between respective brackets 75 and 76. A guard assembly 77 is mounted to the frame 12 and extends alongside the entry pin roller 70 to shield the entry pin roller. The backing transport system 14 further comprises a pair of guide rollers 78 and 79 which cooperate with the pin rollers 70 and 71, respectively, to guide the backing 16. The guide rollers 78 and 79 are mounted to the frame 12 and extend between respective brackets 80 and 81. The pin roller motors are connected to the pin rollers 70 and 71 with couplings.

A second pair of pin rollers 90 and 91, which have smaller diameters than the entry and exit pin rollers 70 and 71, are located closely adjacent to reciprocating needles 18 on the opposite sides of the backing 16. These additional pin rollers 90 and 91 provide better control of the backing 16 in the area adjacent to where the yam tufts are implanted. The smaller pin rollers 90 and 91 are carried on respective brackets 92 and 93.

The backing transport system 14 further comprises a pair of bed plates 94 and 96 for supporting the backing 16 as the backing moves through the tufting apparatus 10. One of the bed plates 94 is positioned below the backing 16 and upstream of the reciprocating needles 18 between the reciprocating needles and the entry pin roller 70. The other of the bed plates 96 is positioned above the backing 16 and downstream of the reciprocating needles 18 between the reciprocating needles and the exit pin roller 71. The bed plates 94 and 96 are transversely shiftable relative to the backing advance direction.

Each of the bed plates 94 and 96 are carried on a pair of transversely extending rods 100 and 102 affixed to the frame 12. The bed plates 94 and 96 are connected at each end by respective connecting members 104 and 105. The entry and exit pin rollers 70 and 71 are preferably also carried by the shiftable bed plates 94 and 96, respectively. The connecting members 104 and 105 are connected to respective electric motors (not shown) with respective commercially available ball screw drives. The ball screw drives should be capable of producing very small and precisely controlled transverse movements when rotated by the motors. Specifically, this precision mechanism should enable precisely controlled incremental movements of the order of one tenth of an inch or less. The motors and the ball screw drives shift the bed plates 94 and 96, as well as the pin rollers 70 and 71, transversely toward the longitudinal direction of advancement of the backing which produces a corresponding transverse shifting movement of the backing 16 so that each needle 18 may insert yarn into the backing at a number of transverse locations. The guide rollers 78 and 79 may also be shifted transversely in substantial correspondence with the pin rollers 70 and 71 by a second, less precise shifting mechanism.

The Yarn Applicator

The needles 18 of the yarn applicator 20 are reciprocated by adjustable cam assemblies 110 which are coupled to the needles by respective link assemblies 112. The adjustable cam assemblies 110 are shown in FIG. 1 and comprise a circular cam lobe member 114 rotatably supported by bearings within a circular portion of a yoke member 116. The cam lobe members 114 are carried on and driven by a transversely extending rotatable shaft 118 which is offset from the center of each cam lobe member and preferably supported by bearings on a bearing support 120. The link assemblies 112 comprise a coupling link 122 which is pivotally connected to a yoke member 116 and connected to a vertically extending push rod 124. Each vertically extending push rod 124 extends through and is guiding for vertically reciprocal movement by bearings 126 mounted to the bottom of the main drive housing 64.

Figure 4:
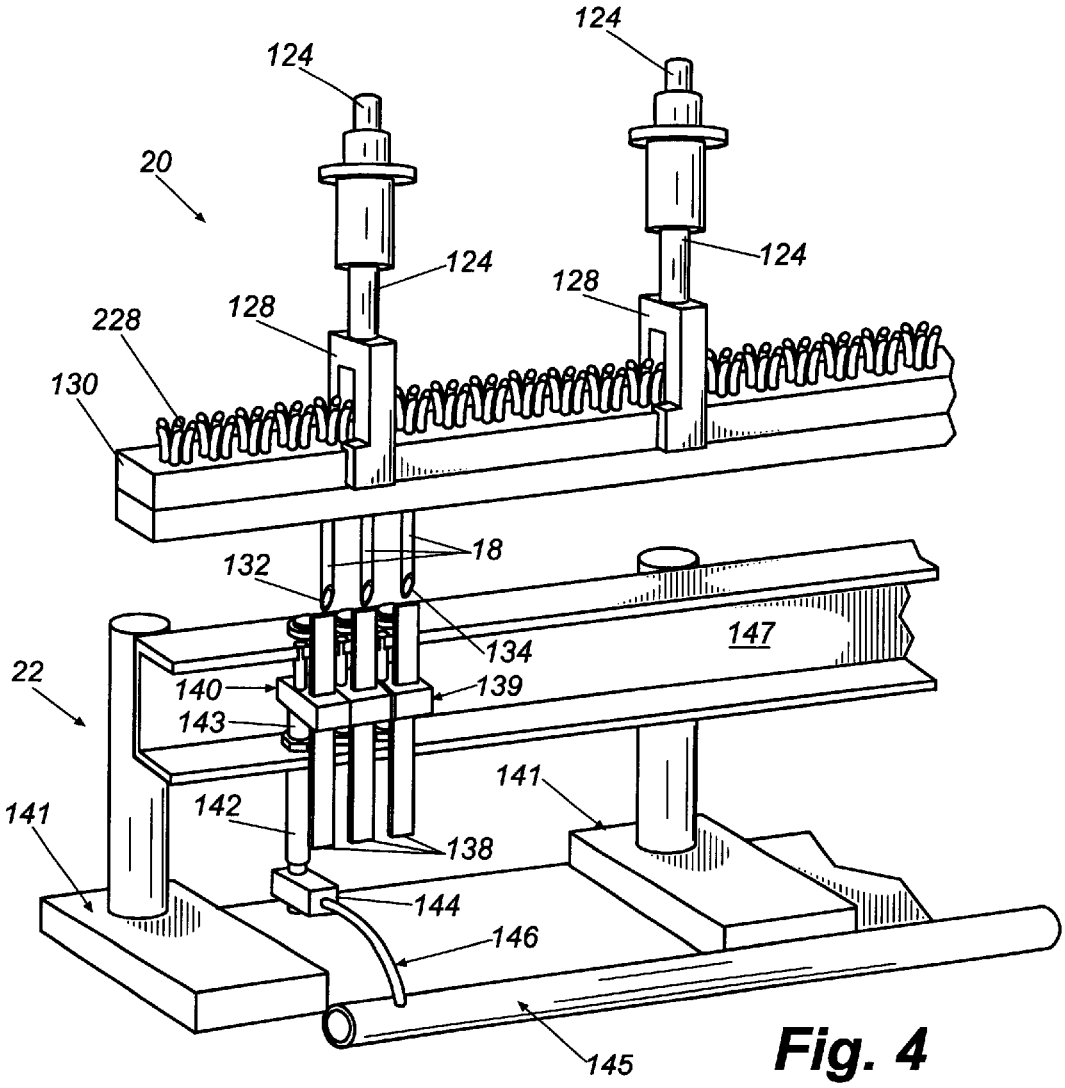
FIG. 4 is a partial perspective view of the yarn applicator and cutting system of the embodiment in FIG. 1.

As best shown in FIG. 4, the lower ends of the push rods 124 are connected to respective mounting blocks 128 which are, in turn, connected to a transversely extending needle mounting bar 130, which is also referred to as a yarn exchanger. The needles 18 are mounted to the mounting bars 130. In FIG. 1, only one needle 18 is illustrated, but it should be understood that a plurality of needles 18 extend along the length of the needle mounting bar 130. Upon rotation of the shaft 118, the adjustable cam assemblies 110 rotate to impart a reciprocating movement to the yoke members 116 and, in turn, a similar movement to the needles 18 via the link assemblies 112 to cause the needles to repetitively penetrate and withdraw from the backing 16.

The needle mounting bar 130 is rectangular in cross-section, and for each needle 18, has a central passage (not shown) extending from an inlet at the top of the mounting bar to a funnel and a plurality of yarn passages (not shown) surrounding each central passage and extending from respective inlets in the top of the mounting bar to the funnel. Each funnel extends from an inlet an outlet at the bottom of the mounting bar. This arrangement is illustrated in detail in U.S. Pat. No. 5,165,352, already incorporated herein by reference.

The needles 18 each have a hollow passage extending from an inlet to an outlet 132 at an angled pointed tip 134. The structure of the needles is disclosed in more detail in U.S. Pat. No. 4,991,523, the disclosure of which is already expressly disclosed herein by reference. Each needle 18 is disposed such that the inlet of the needle is in communication with the outlet of the respective funnel.

The yarn applicator 20 is driven by electric motors (not shown) operatively connected to opposite ends of the main drive shaft 118 and mounted to opposite ends of the main drive housing 64 for rotating the main drive shaft. For high product throughput, the main drive motors should rotate the main drive shaft 118 at speeds up to about 1000 rpm.

Each rotation of the main drive shaft 118 causes the needles 18 to penetrate and then withdraw from the backing 16. In other words, each rotation of the main drive shaft 118 causes one needle reciprocation cycle, also referred to as a tufting cycle, which includes a downstroke and an upstroke of the needles 18.

Figure 5:
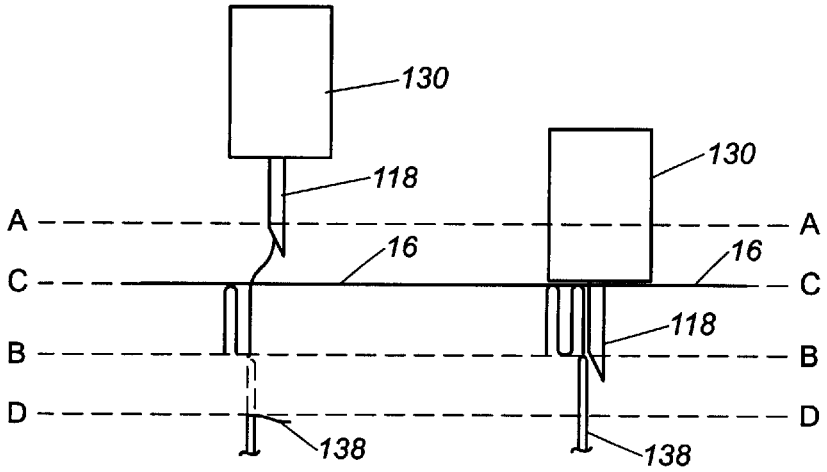
FIG. 5 is a schematic diagram of a tufting cycle of the embodiment in FIG. 1.

During each tufting cycle the hollow needles 18 of the yard applicator 20 reciprocate between a top position A and a bottom position B as illustrated in FIG. 5. The backing 16 is positioned between the top position A and the bottom position B of the tufting cycle. In one cycle, the angled pointed tip 134 of each hollow needle 18 travels from the top position A to the bottom position B and back to the top position A. Between the top position A and the bottom position B, the hollow needle 18 penetrates the backing 16 and implants a yard tuft therein. The movement of the hollow needle 18 between the top position A and the bottom position B is the downstroke of the cycle and the movement of the needles from the bottom position B to the top position A is the upstroke of the cycle.

The Yarn Cutting System

As shown in FIGS. 1 and 4, the yarn cutting system 22 is positioned below the backing transport system 14 and comprises a plurality of knife blades 138, one positioned below each of the needles 18 for cutting the yarn implanted into the backing 16 by the needle at the downstroke of each tufting cycle. The knife blades 138 are arranged to cooperate with the needles 18 by sliding over the respective angled tips of the needles 18 in a shearing-like action to cut the yarn that is ejected from the needles. The yarn cutting system 22 further comprises a blade holder 139, a mechanism 140 for reciprocating the knife blade 138, and a frame 141 for supporting the knife blade, blade holder, and reciprocating mechanism.

It should be noted that FIG. 4 is only a partial illustration and not all of the knife blades and reciprocating mechanisms are illustrated.

The reciprocation mechanism 140 for each blade 138 comprises an air cylinder 142 for driving a shaft 143 in a vertical reciprocating motion and an air solenoid 144 for activating the air cylinder. A pressurized air supply pipe 145 supplies air to the air cylinder 142 as shown in FIG. 4. Tubes 146 supply the pressurized air supply pipe 145 with pressurized air from a source of pressurized air.

The knife blades 138, blade holders 139, and reciprocating mechanisms 140 are mounted to the cutting system frame 141 along a transverse C-bar 147. As will be explained in more detail below, each of the knife blades 138 is individually controlled and can be individually reciprocated independent of the other so that on any penetration by any needle 18, the respective knife blade 138 can be positioned to form a cut tuft or form a loop tuft.

The reciprocating mechanisms 140 move the knife blades 138 and blade holders 139 up and down synchronous with the reciprocating movements of the hollow needles 18. The knife blades 138 reciprocate between a bottom position D and a top position C as illustrated in FIG. 5. Each stroke of the knife blades 138 includes an upstroke from the bottom position D to the top position C and a downstroke from the top position C to the bottom position D. In the top position C, the knife blades 138 engage respective hollow needles 18 and cut the yarn.

The structure of the yarn cutting system 22 is disclosed in more detail in U.S. Pat. No. 5,588,383, the disclosure of which is already expressly disclosed herein by reference.

The Presser Feet

To prevent the needles 18 from raising the backing 16 when the needles are removed from the backing during the upstroke of the yarn applicator 20, a plurality of presser feet 24 are disposed adjacent the needles transversely across the tufting apparatus 10 and slightly above the backing. The presser feet 24 are connected to an elongated rail member 150, shown in FIG. 1, with means such as screws. The rail member 150 is connected to the underside of the main drive housing 64 with arms 152 to fix the presser feet 24 to the tufting apparatus frame 12.

Each of the presser feet 24 extend below the needles 18 and have a plurality of bores corresponding to each needle and through which the respective needles may reciprocate freely. Air conduits 154 communicate with each of the needle bores. Pressurized air is blown through the conduits 154 by corresponding tubes 155 connected to a pressurized air pipe 156.

Pressurized air is directed through the conduits 154 and into the needle bores as the needles 18 are withdrawn from the backing 16. This air forces the severed limb of yarn, which is the limb forming the last backstitch and which is no longer connected to the needle, down into the opening in the backing before the needle makes a subsequent opening. This eliminates the excess yarn on the rear of the backing and precludes the yarn from forming a backstitch raised above the surface of the backing material. Each air conduit 154 is desirably disposed at an angle of about 45° relative to the axis of the respective needle 18. The presser feet 154 are similar to those disclosed in U.S. Pat. No. 5,158,027, the disclosure of which is already expressly incorporated herein by reference.

The Yarn Supply System

The tufting apparatus 10 supplies a plurality of different yarns to each needle 18 of the tufting apparatus. The yarns are desirably of a different color so that the tufting apparatus 10 can be used to make multicolor patterned tufted goods such as carpet. The tufting apparatus 10 has a plurality of needles spaced apart. The particular number of needles depends on the product to be produced and the level of throughput desired. The tufting apparatus 10 is capable of selecting, for any given needle 18, on any given needle reciprocation cycle, one of the plurality of different yarns and delivering the desired length of that yarn to the respective needle. In addition, the tufting apparatus is capable of simultaneously withdrawing one yarn from a needle 18 and inserting another yarn into that needle in the same needle reciprocation cycle.

Yarn is supplied to the tufting apparatus 10 through overhead tubes from a creel (not shown). The creel generally comprises a frame for holding a plurality of yarn spools. The structure and function of such creels is well known to those skilled in the art and is not discussed herein in detail.

The yarn feed mechanism 26 is disposed adjacent the push rod 124 of the yarn cutting system 22 and extends between the vertical end frames 40 of the tufting frame 12 along the inlet and exit sides 59 and 61 of the tufting apparatus. The yarn feed mechanism 26 on each side of the tufting apparatus 10 are identical to each other, but in reverse image. Each yarn feed mechanism 26 comprises a driven roller 162 extending between end panel 62 of the vertical end frames 40. In addition, each yarn feed mechanism 26 includes a yarn feeder 164 which is driven by the driven roller 162, an actuator 166 pivotally connected to the yarn feeder for pivoting the yarn feeder, and a yarn pullback mechanism 168 disposed intermediate the yarn feeder and the reciprocating needle 18 and mechanically linked to the yarn feeder. The tufting apparatus 10 includes a plurality of yarn feeders 164, yarn feeder actuators 166, and yarn pullback mechanisms 168 extending along the length of the tufting apparatus adjacent the respective driven rollers 162. The tufting apparatus 10 includes a yarn feeder 164, a yarn feeder actuator 166, and a yarn pullback mechanism 168 for each yarn fed from the yarn supply 28 to the reciprocable tufting needles 18. Accordingly, there are several yarn feeders 164, actuators 166, and yarn pullback mechanisms 168 associated with each tufting needle 18.

Each driven roller 162 is concentrically mounted about a drive shaft 170 which extends the length of the tufting apparatus 10. Each drive shaft 170 is independently driven by respective electric motors (not shown). Therefore, each driven roller can be rotated at different speeds allowing for different yarn feed rates. As will be explained in more detail below, this allows for tufts of different pile height in the same tufted good.

Each driven roller 162 has gear teeth 172 about its periphery 174. Although the driven roller 162 can be made of any suitably rigid material, each driven roller 162 is desirably made of plastic and is segmented so that only a portion of the driven roller 162 has to be replaced if the driven roller is damaged.

Each yarn feeder 164 comprises a moveable member 176 comprising a pair of plates spaced from one another to form a gap there between. Each moveable member 176 comprises an elongate upper portion or leg 178 and a wider lower portion or foot 180. Each moveable member is pivotally mounted to a journal member 182 extending between the vertical end frames 40 of the tufting frame 12. The journal member 182 extends through a central portion of each moveable member 176.

A pair of geared feed rollers 184 and 186 are pivotally disposed in the foot 180 of each moveable member 176 for feeding yarn 160 from the yarn supply 28 toward the respective tufting needle 18. Each pair of geared feed rollers 184 and 186 have gear teeth 188 and 190 and are arranged so that the teeth of the gear feed rollers are engaged to form a nip 192 between the feed rollers. One of the feed rollers 186 is disposed so as to selectively engage and disengage from the teeth 172 of the respective driven roller 162. Each yarn feeder 164 is disposed for selectively moving into peripheral engagement with the respective driven roller 162, and alternatively, moving out of peripheral engagement with the driven roller. The geared feed rollers 184 and 186 are driven by the respective driven roller 162 when engaged with the driven roller and feed yarn toward the respective tufting needle. The gear feed rollers 184 and 186 do not feed yarn, but rather hold the yarn still, when not engaged with the respective driven roller 162.

Each yarn feeder actuator 166 moves the respective yarn feeder 164 into and out of peripheral engagement with the respective driven roller 162. Suitable actuators include a pneumatic cylinder 196 which is illustrated in FIG. 1, and other reciprocating devices such as an electric solenoid or a hydraulic actuator. The pneumatic actuator 196 includes a rod 198 which extends from the pneumatic cylinder 196 to an arm 200. The arm 200 is pivotally connected to the leg 178 of the moveable member 176 so that the actuator can pivot the moveable member about the journal member 182.

Each yarn pullback mechanism 168 is disposed intermediate the respective yarn feeder 164 and the respective reciprocating needle 18. Each yarn pullback mechanism 168 is mechanically linked to the respective yarn feeder 164 such that when the respective actuator 166 moves the yarn feeder out of engagement with the respective driven roller 162, the yarn pullback mechanism lengthens the path between the yarn feeder and the reciprocating needle and draws the yarn 160 back from the reciprocating needle. When the actuator 166 moves the respective yarn feeder 164 into engagement with the respective driven roller 162, the yarn pullback mechanism 168 shortens the path between the respective yarn feeder and the respective reciprocating needle.

Each yarn pullback mechanism 168 includes an L-shaped yarn pullback member 202 comprising a leg 204 extending from one end 206, which is pivotally connected to a rod extending between the vertical inframes 40 of the tufting frame 12, and a foot 208 which extends from another end of the leg 204 to a distal end 210. The foot 208 of the yarn pullback member 202 includes a passageway to 12 for receiving the yarn 160 as the yarn is feed from the yarn feeder 164. The yarn pullback mechanism 168 also includes an arm 214 which pivotally connects the one end 206 of the yarn pullback member leg 204 to the foot 180 of the respective yarn feeder moveable member 176. The arm 214 is pivotally connected to both the yarn pullback member leg 204 and the yarn feeder moveable member 176. The yarn pullback mechanism 168 is arranged so that the yarn pullback member 202 pivots and rocks the foot 208 back and forth and in sync with the pivoting action of the yarn feeder 164 driven by the respective actuator 166.

Desirably, a yarn guide bar 220 is disposed intermediate the foot 180 of each moveable member 176 and the respective yarn pullback member 202 along the length of the tufting apparatus 10. The yarn guide bar 220 has a passageway 222 adjacent each yarn feeder 164 for receiving the yarn 160 as the yarn passes from the yarn feeder to the passageway in the respective member foot 208.

A stationary manifold bar 224 extends between the vertical end frames 40 of the tufting frame 12 and receives the yarn 160 from each of the yarn feeders 164 along the length of tufting apparatus. The manifold bar 224 has a plurality of passageways through which the yarns 160 pass. These passageways (not shown) lead the yarns to respective flexible yarn delivery tubes 228 which extend from the manifold bar 224 to respective yarn passageways in the needle mounting bar 130. In addition, the manifold bar 224 includes a plurality of respective pressurized air conduits 226 for receiving pressurized air and directing it through the yarn passageways and the manifold bar and flexible yarn delivery tubes 228 to force the yarns 160 through the respective yarn delivery tubes, through the passageways in the needle mounting bar and through the hollow needles 18.

The Control System

Figure 6:
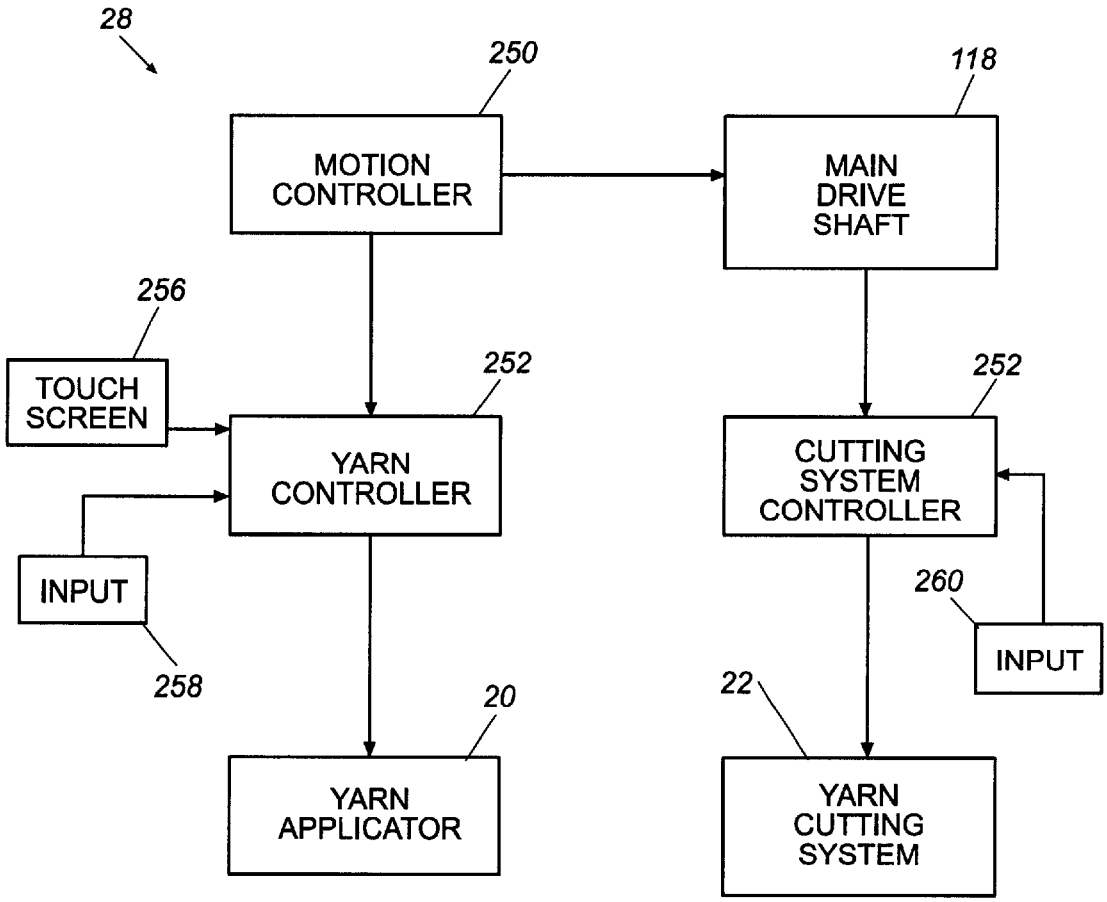
FIG. 6 is a schematic diagram of the control system of the embodiment in FIG. 1.

The control system 28 of the tufting apparatus 10 receives instructions from an operator for making a particular product such as a patterned carpet and controls the various subsystems of the tufting apparatus, including the backing transport system 14, the yarn applicator or needle drive system 20, the yarn cutting system 22, and the yarn feed or supply mechanism 26, in accordance with the operator's instructions to make the desired product. As shown in the schematic diagram of FIG. 6, the control system 28 for the tufting apparatus 10 comprises a motion controller 250 for controlling the motors driving the backing transport system 16, the yarn applicator 20, and the yarn supply mechanism 26, a yarn controller 252 which is a computer, a yarn cutting system 254 which is also a programmable computer, and an operator control interface 256. The function of each of the components of the control system 28 is described below in detail so that one skilled in the art can obtain or prepare the appropriate software to carry out the respective functions.

The motion controller 250 controls and coordinates the large motors mounted on the tufting apparatus 10 for driving the backing transport system 16, the yarn applicator 20 via the main drive shaft 118, and the yarn supply mechanism 26 via the driven rollers 162. The motion controller 250 communicates with the yarn controller 252 and generates data representing the position and speed of movement of the main drive shaft 118. The motion controller includes a computer and is desirably a GALIL model 1040 motion controller manufactured by GALIL Motion Control, Inc., of Sunnyville, Calif.

The yarn controller 252 is a personable computer programmed with operator utility software and run time software and generally stores yarn color pattern information and controls operation of the yarn applicator 20 in accordance with the selected multi-colored pattern. The operator utilities software includes functions such as selecting pattern files from a pattern input 258 such as a floppy or hard drive, decompressing or compressing pattern files, changing pattern colors, setting up the yarn creel, and performing diagnostic functions with the yarn control input/output. Desirably, patterns such as multi-colored patterns for carpet are scanned using a conventional multi-color pattern scanning device, translated into a pattern file, and down loaded onto a floppy disk or the hard drive of the yarn controller 252. The operator can input instructions through the operator control interface 256 for the timing of the tufting operation.

The run time software is the code that controls the yarn colors and pattern generation during operation of the tufting apparatus 10. The run time software allocates the pattern information from the pattern file to the correct needles 18 at the correct time relative to the position of the main driveshaft 118.

The cutting system controller 254 is also a programmable personal computer and controls the yarn cutting system 22 in accordance with a cut/loop pattern so as to selectively cut the yarn and plant it in the backing to form a cut tuft or alternatively form a loop tuft, so that the tufted good has both cut tufts and looped tufts. Like the yarn controller 252, the cutter controller 254 includes operator utility software and run time software. The cutting system controller 254, however, receives and stores cut/loop pattern information from a cut/loop pattern input 260 such as a floppy disk or hard drive.

The run time software of the cutting system controller 254 allocates the pattern information to the appropriate knife blades 113 at the correct time relative to the main shaft 118 position, and sends a signal to the appropriate knife blade reciprocating mechanisms 140 to selectively cut yarn or not cut yarn to form the desired cut/loop pattern. Although the yarn controller 252 and the cutting system controller 254 are synchronized, they operate independently of one another so that yarn color patterns and cut/loop patterns can be implemented independently for each tufted good. Therefore, any yarn color pattern can be combined with any cut/loop pattern to produce a wider variety of tufted goods.

OPERATION OF THE TUFTING APPARATUS

Once the tufting apparatus 10 is properly set up, the tufting apparatus can produce, in one pass, a tufted multi-colored patterned carpet. For example, the tufting apparatus 10 can be set up to deliver six different yarns to each needle, but also could be set up to produce carpet having a pattern with more or less than six colors. In addition, the tufting apparatus 10 can produce a patterned carpet having some cut tufts and some loop tufts. The cut and loop tufts can be arranged to form a pattern themselves independent from the yarn color pattern. Furthermore, the tufting apparatus can be set up to produce a patterned carpet having tufts of different pile heights in the same carpet and can be set up to produce patterned carpet having tight tufts or loose tufts. These methods are explained in more detail below.

To set up the tufting apparatus 10, the control system 30 is first programmed with the appropriate pattern and the timing data and the air pressures for the pneumatic systems and the presser foot are set via the operator control interface touch screen 256 to levels appropriate for the types of yarns being used. The yarn color pattern is fed to the yarn controller 252 through the yarn color pattern input 258 and the cut/loop pattern is fed to the cutting system controller 254 through the cut/loop pattern input 260. The speeds of the driven rollers 162 in the yarn supply system 20 are set to achieve the desired pile height or tightness of tufts. Next, the backing 16 is fed into the backing transport system 14, and the yarns are mounted on the creel and fed through overhead tubes, the yarn supply mechanisms 26, and the yarn delivery tubes 228 to the yarn applicator 20.

The yarn controller 252 is also programmed with the stitch gauge of the pattern being used so that the backing advance motors, the backing shifting motors and the main drive motors cooperate to reproduce the desired pattern in the tufted product. For example, if the needles 18 in the tufting apparatus 10 are spaced 1" apart, if the gauge, which is the spacing between the adjacent tufts, is 10, then there are ten tufts per inch along a transverse row of tufts. Accordingly, the backing shifting motors must shift ten times per inch to produce the transverse movement of the backing 16. To produce a tufted product without visible interfaces between stitches made by adjacent needles, the backing advance must move constantly while the backing shifting motors shift incrementally back and forth during tufting by the needles 18. This actually produces a chevron pattern of tufts which, in a finished tufted product, is not visible on the face of the product. The method for producing such a chevron pattern is disclosed in detail in U.S. Pat. No. 5,205,233, the disclosure of which is incorporated herein in its entirety.

The tufting operation is begun by the operator by sending a start signal to the computer. The backing transport system 14, the yarn applicator system 20, the yarn cutting system 22, and the yarn feed mechanism 26 then begin simultaneous operation to produce carpet having the pattern being implemented by the control system 30. Each full rotation of the main drive shaft 118 is a cycle of the tufting apparatus 10. Through the adjustable cam assemblies 110 and the link assemblies 112, the needles 18 are reciprocated by the rotation of the main drive shaft 118. For every rotation of the main drive shaft 118, the needles 18 reciprocate through a full cycle which includes a downstroke and upstroke. During each reciprocation cycle of the yarn applicator 20, the needles 18 can implant a yarn tuft into the backing 16. As the backing advance motors advance the backing 16 and the backing shifting motors move the backing transversely to the direction of advancement of the backing, the reciprocating needles 18 penetrate the backing and implant yarn in the backing successively along transverse rows.

During each cycle of the tufting apparatus 10, yarns are fed to the needles 18 by the yarn feeders 164. The yarn feeders can feed a yarn to each needle 18 during each stroke so that a yarn is tufted by each needle at each penetration of the backing 16 by the needles. In accordance with data sent by the yarn controller 252 to tufting apparatus 10, the yarn feed mechanisms 26 either feed yarn, retract yarn, or hold yarn in accordance with the pattern being implemented by the yarn controller. During each cycle of the tufting apparatus, one yarn feeder 164 can be feeding yarn, while a yarn pullback mechanism 168 is retracting the yarn previously fed. The yarn pullback mechanisms 168 associated with the same needle are holding yarn.

Figure 2:
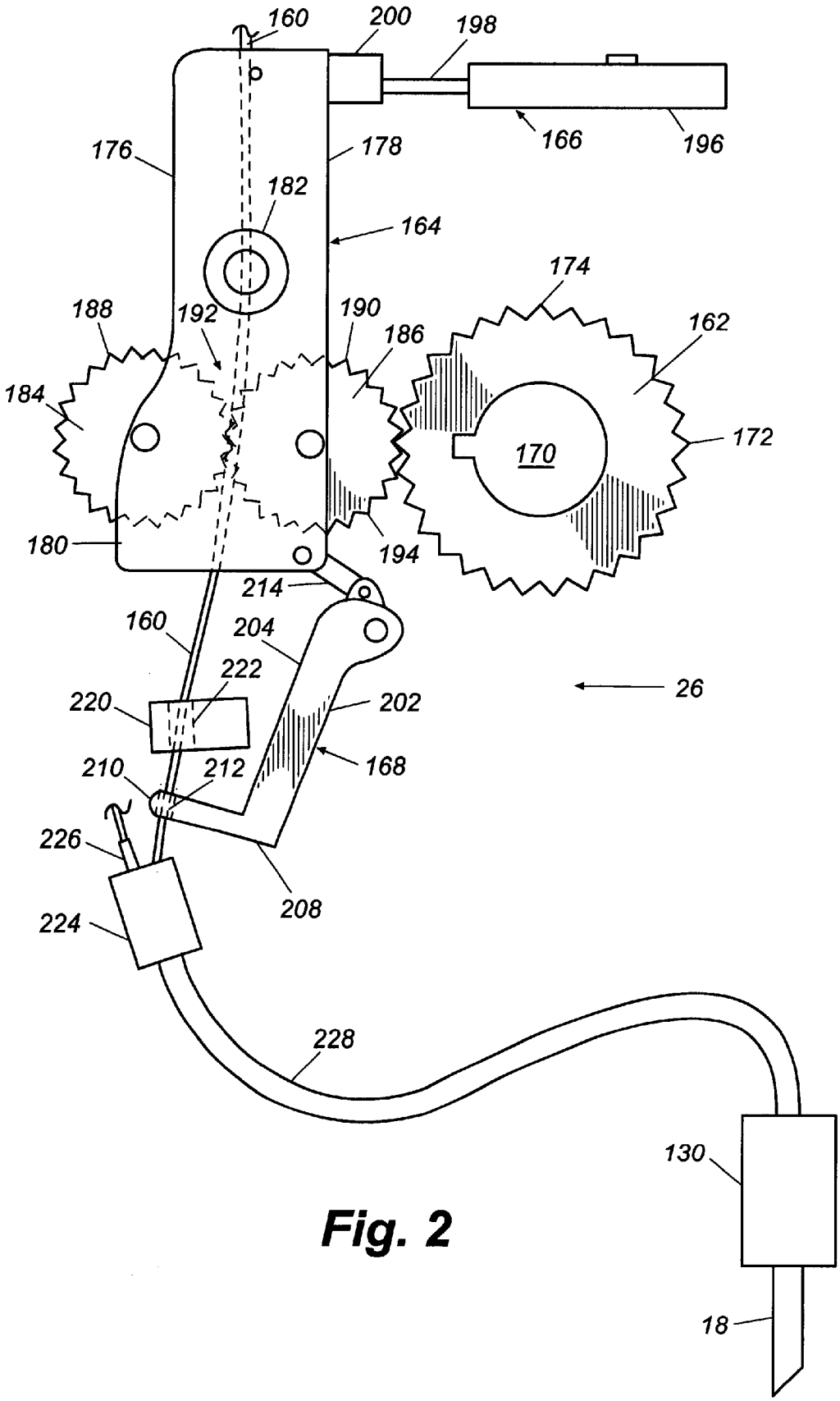
FIG. 2 is a partial plan view of a yarn feed mechanism which forms part of the tufting apparatus shown in FIG. 1. In this view, the yarn feed mechanism is in a configuration for feeding yarn to a needle of the tufting apparatus.

As best shown in FIG. 2, each yarn 160 is feed by a respective yarn feeder 164 toward the yarn manifold 224. The pair of feed rollers 184 and 186 and the moveable member 176 of the yarn feeder 164 feed the yarn 160 through the nip 192 between the feed rollers. When it is time for a particular yarn 160 to be feed, the actuator 166 for the respective yarn feeder 164 pivots the moveable member 176 of the yarn feeder so that one of the feed rollers 186 engages the respective driven roller 162. The driven roller 162 drives the pair of feed rollers 184 and 186 so that the yarn 160 is pulled from the yarn supply 28, through the nip 192 between the feed rollers and out of the foot of the moveable member 176 toward the adjacent yarn guide bar 220. The yarn passes through the respective passageway 222 and the yarn guide bar 220 and then passes through the passageway 212 in the foot 208 of the respective yarn pullback member 202. From the yarn pullback member 202, the yarn 160 travels through the respective passageway and the manifold bar 224 and is driven by pressurized air from the manifold bar through the respective flexible yarn delivery tube 228 to the needle mounting bar 130. Lastly, the yarn travels from the needle mounting bar 130 through the respective needle 18 and out of the end of the needle whereupon the yarn is sheared by the respective cutting blade 140 of the yarn cutting system 22. The cut yarn forms a tuft in the backing 16.

Figure 3:
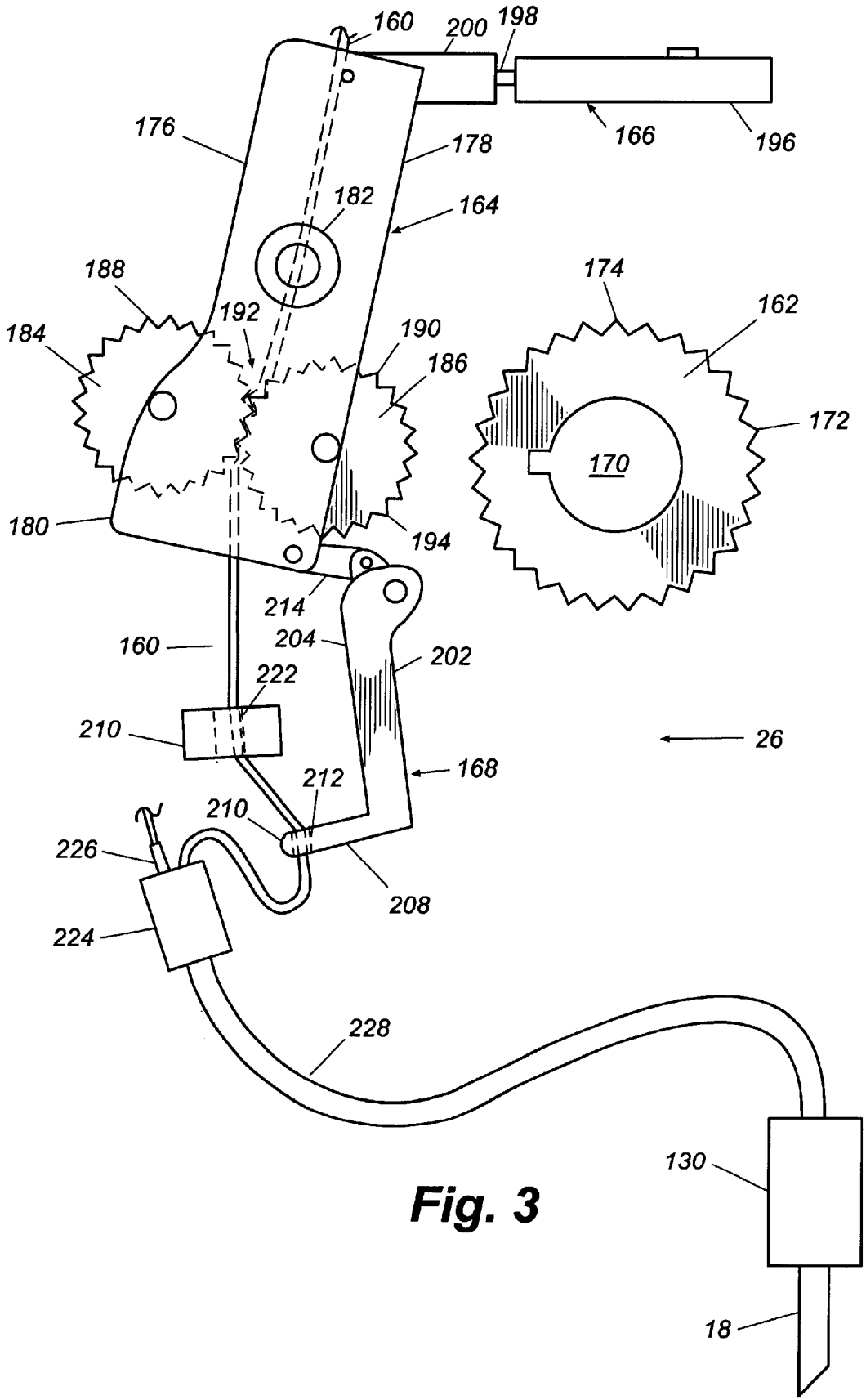
FIG. 3 is another partial plan view of the yarn feed mechanism shown in FIG. 2. In this view, the yarn feed mechanism is in a configuration for pulling yarn back from a needle of the tufting apparatus.

As shown in FIG. 2, while the yarn feeder 164 is feeding yarn 160, the yarn pullback member 202, which is mechanically linked to the moveable member 176 of the yarn feeder 164, is positioned intermediate the yarn guide bar 220 and the manifold bar 224 so that the yarn passes along a reduced path through the foot 208 between the yarn guide bar and the manifold. As shown in FIG. 3, when it is time to retract the yarn 160 from a particular needle 18, the actuator 166 of the respective yarn feeder 164 pulls on the leg 178 of the yarn feeder moveable member 176 and pivots the foot of the moveable member away from the driven roller 162 so that the feed rollers 184 and 186 disengage from the driven roller. Simultaneously, the arm 214 connecting the moveable member 176 of the yarn feeder 164 to the yarn pullback member 202 causes the yarn pullback member to pivot and draw the foot 208 of the yarn pullback member away from the yarn guide bar 220 and the manifold bar 224 thereby lengthening the path traveled by the yarn 160 and withdrawing the yarn back through the needle 18 and the respective flexible yarn delivery tube 228. While the yarn pullback member 202 draws the yarn 160 back through and out of the needle 18, the feed rollers 184 and 186 hold the yarn 160 tightly so that the yarn pullback member does not pull yarn through the feed rollers from the yarn supply 28.

Because the yarn pullback mechanism 168 is mechanically linked to the yarn feeder 164, the yarn feed and yarn pullback is synchronized and the tufting apparatus produces tufts more reliably. In addition, the use of a mechanical yarn pullback mechanism reduces the need for more pressurized air and reduce the operating cost of the tufting apparatus.

The tufting apparatus 10 can be set up and operated in different ways to produce tufted goods such as tufted carpet having different, but desirable characteristics. As summarized above, the tufting apparatus can be operated so that yarn color patterns and cut/loop patterns are implemented independently to achieve a multitude of combinations of color patterns and cut/loop patterns. This is possible because the yarn controller 252 and the cutting system controller 254 are independently programmable and separately operate the yarn applicator system 20 and the yarn cutting system 22, respectively. Although the operation of the yarn applicator system 20 and the yarn cutting system 22 are synchronized, the patterns are implemented independently so that different yarn color patterns can be matched with different cut/loop patterns.

The tufting apparatus can produce pattern tufted goods such as pattern tufted carpet having different pile heights by driving the driven rollers 162 of the yarn supply mechanism 26 at different speeds. Because the yarn applicator system 20 is operating at one speed and both of the driven rollers 162 on each side of the tufting frame 12 feed yarn through the same yarn applicator system 20, the speed of the driven rollers determines the lengths of yarn in each tuft. Therefore, by rotating the driven rollers 162 at different speeds, different lengths of yarn are supplied during each tufting cycle and tufts having different pile heights are produced. Thus, the yarn controller 252 can be programmed to select yarn from the particular ones of the driven rollers 162 and the yarn supply mechanism 26 to produce a tufted carpet having a desired pattern of differing tuft pile heights.

According to another embodiment of this invention, the tufting apparatus 10 can be operated to produce pattern carpet having tight or loose tufts. This is achieved by setting the speed of the driven rollers 162 in the yarn supply system 26 so as to feed lengths of yarn in each tufting cycle either greater or less than the displacement distance of the hollowed tufting needles 18 during each tufting cycle.

As illustrated in FIG. 5, during one tufting cycle, the hollow needles 18 travel from a first position A above the backing 16, through the backing, to a bottom position B below the backing, and then from the bottom position B back up to the top position A. The distance traveled by the needles 18 from the top position A to the bottom position B and back to the top position A is the displacement distance of the needles. By setting the speed of the driven rollers 162 in the yarn supply system 26 at a sufficiently slow rate, the length of yarn supplied during each tufting cycle can be shorter than the displacement distance of the needles 18 to form tight tufts. When the length of yarn fed to the hollow needles is short, the hollow needles pull the yarn tightly during tufting. Conversely, by setting the speed of the driven rollers 162 of the yarn supply mechanism 26 sufficiently high, yarn having the length greater than the displacement distance of the needles 18 can be supplied to form loose tufts. Therefore, the tufting apparatus 10 can produce tufted carpet having a very uniform array of tight tufts or a more loose array of tufts.

Desirably, the yarn cutting knife blades 138 engage the angle tips 134 of the hollow needles 18 when the hollow needles reach the bottom position B of their downstroke and the knife blades reach the top position B of their upstroke and before the yarn applicator 20 begins an upstroke. If there is a lag and the yarn applicator 20 begins an upstroke before the knife blades 138 reach the top position B of their upstroke, the yarn tufts will not be properly cut. Preferably, the knife blades 138 begin their upstroke at about the same time as the yarn applicator and the hollow needles 18 begin their downstroke. Preferably, the tufting apparatus produces a signal at the beginning of each downstroke of the yarn applicator 20 that causes the selected knife blades 138 to begin their up stroke so that the knife blades engage the angled tips 134 of the hollow needles 18 when the hollow needles are at the bottom of their downstroke and the knife blades are at the top of their upstroke. This signal can be emitted by the main drive shaft 118 or the motion controller 250 and is received by the cutting system controller 254. The cutting system controller 254 then transmits the appropriate signal to the selected reciprocating mechanisms 140 for the knife blades 138.

It should be understood that the foregoing relates to particular embodiments of the present invention and that numerous changes can be made therein without departing from the scope of the invention as defined by the following claims.

I claim:

1. Apparatus for producing patterned tufted goods comprising:

a tufting frame;

a backing transport system mounted to the frame for advancing a backing in a direction past a yarn applying region;

a yarn applicator disposed at the yarn applying region and mounted to the frame for penetrating the backing and implanting the yarn in the backing successively along a row during movement of the backing to form a plurality of yam tufts in the backing;

a yarn supplier for supplying a plurality of continuous lengths of different yarns to the yarn applicator, a yarn cutter for selectively cutting the yarn implanted in the backing;

a first control system for controlling the yarn supplier in accordance with a color pattern so as to select which of the continuous lengths of yarns, if any, is implanted in the backing at each penetration; and a second control system independent of the first control system for controlling the yarn cutter in accordance with a cut/loop pattern so as to selectively cut the yarn implanted in the backing to form a cut tuft or alternatively form a loop tuft, so that a tufted good has both cut tufts and loop tufts.

2. Apparatus as in claim 1 wherein the first control system comprises a first programmable computer and the second control system comprises a second programmable computer independently programmable from the first computer.

3. Apparatus as in claim 1 wherein the yarn applicator comprises a plurality of hollow tufting needles and the yarn cutting system comprises a plurality of cutting elements for selectively engaging respective hollow tufting needles so as to cut the yarn in response to a signal from the second control system as the hollow tufting needles implant the yarn in the backing.

4. Apparatus as in claim 1 wherein the first control system is synchronized with the second control system.

5. Apparatus as in claim 1 further comprising a motion controller for controlling the motion of the yarn applicator and the backing transport system.

6. Apparatus as in claim 1 wherein the backing transport system moves the backing transversely to the direction of advancement of the backing such that the yarn is implanted in the backing successively along a transverse row during transverse movement of the backing to form the plurality of yarn tufts.

7. Method for producing patterned tufted goods comprising:

advancing a backing in a direction past a yarn applying region and moving the backing transversely to the direction of advancement of the backing;

supplying a plurality of continuous lengths of different yarns to a yarn applicator, penetrating the backing with the yarn applicator and implanting a yarn therein successively along a transverse row during transverse movement of the backing to form a plurality of yarn tufts in the backing;

selectively cutting the yarn implanted in the backing at each penetration;

controlling the supplying of the yarn in accordance with a color pattern so as to select which of the continuous lengths of yarns, if any, is implanted in the backing at each penetration; and independently of controlling the yarn supplier, controlling the cutting of the yarn in accordance with a cut/loop pattern so as to select whether the yarn implanted in the backing at each penetration forms a loop tuft or is cut and forms a cut tuft.

8. Method as in claim 7 wherein a first programmable computer controls the supplying of the yarn and a second programmable computer independently programmable from the first computer controls the cutting of the yarn.

9. Method as in claim 1 wherein the yarn applicator comprises a plurality of hollow tufting needles, the yarn cutting system comprises a plurality of cutting elements, the step of controlling the cutting of the yarn comprises sending a signal to the yarn cutting system, and the cutting step comprises selectively engaging the cutting elements with respective hollow tufting needles in response to the signal as the hollow tufting needles implant the yarn in the backing so as to cut the yarn.

10. Method as in claim 7 wherein the step of controlling the yarn applicator is synchronized with the step of controlling the yarn cutting.

11. Method as in claim 7 further comprising controlling the motion of the yarn applicator and the backing transport system with a motion controller.

12. Method as in claim 7 wherein the step of advancing the backing includes moving the backing transversely to the direction of advancement of the backing such that the yarn is implanted in the backing successively along a transverse row during transverse movement of the backing to form the plurality of yarn tufts.

13. Method for producing patterned tufted goods comprising:

advancing a backing in a direction past a yarn applying region;

supplying a plurality of continuous lengths of different yarns to a yarn applicator, penetrating the backing with a reciprocating yarn applicator and implanting a yarn in the backing successively along a row during movement of the backing to form a plurality of yarn tufts in the backing;

controlling the supplying of yarn in accordance with a color pattern so as to select which of the continuous lengths of yarns, if any, is implanted in the backing at each penetration; and selectively cutting with a yarn cutter the yarn implanted in the backing at each penetration by engaging the yarn cutter with the yarn applicator before the yarn applicator begins an upstroke.

14. Method as in claim 13 wherein the penetrating step includes reciprocating the yarn applicator between a top position and a bottom position such that each stroke of the yarn applicator includes a downstroke from the top position to the bottom position and an upstroke from the bottom position to the top position, and the cutting step includes engaging the yarn cutter with the yarn applicator during a stroke of the yarn applicator after the yarn applicator penetrates the backing and before the yarn applicator begins an upstroke.

15. Method as in claim 14 wherein the cutting step includes engaging the yarn cutter with the yarn applicator during a stroke of the yarn applicator as the yarn applicator reaches the bottom position on the downstroke of the yarn applicator cycle.

16. Method as in claim 14 further comprising generating a timing signal during the yarn applicator cycle and controlling the yarn cutter so that the yarn cutter engages the yarn applicator in response to the timing signal.

17. Method as in claim 14 wherein the timing signal is generated when the yarn applicator reaches the top position on the upstroke.

18. Method as in claim 13 wherein the yarn applicator comprises a plurality of hollow tufting needles, the yarn cutter comprises a plurality of corresponding cutting elements, and the cutting step comprises selectively engaging the cutting elements with respective hollow tufting needles.

19. Method as in claim 18 wherein the cutting step includes selectively reciprocating the cutting elements into engagement with the hollow tufting needles.

20. Method as in claim 16 wherein the cutting step includes selectively reciprocating the yarn cutter into engagement with the yarn applicator so that, in response to the timing signal, the yarn cutter moves toward the yarn applicator as the yarn applicator is on the downstroke.

21. Method as in claim 20 wherein the cutting step includes reciprocating the yarn cutter between a bottom position and a top position such that each stroke of the yarn cutter includes an upstroke from the bottom position to the top position and a downstroke from the top position to the bottom position, the timing signal is generated when the yarn applicator reaches the top position on the upstroke, and the cutting step includes engaging the yarn cutter with the yarn applicator in response to the timing signal during a stroke of the yarn applicator as the yarn applicator reaches the bottom position on the downstroke of the yarn applicator cycle and the yarn cutter reaches the top position of the yarn cutter stroke.

22. Method as in claim 13 wherein the step of advancing the backing includes moving the backing transversely to the direction of advancement of the backing such that the yarn is implanted in the backing successively along a transverse row during transverse movement of the backing to form the plurality of yarn tufts.

23. Apparatus for producing patterned tufted goods having differing pile heights comprising:

a tufting frame;

a backing transport system mounted to the frame for advancing a backing in a direction past a yarn applying region;

a yarn applicator disposed at the yarn applying region and mounted to the frame for penetrating the backing and implanting a yarn therein successively along a row during movement of the backing to form a plurality of yarn tufts in the backing;

a first yarn supplier for supplying a continuous length of at least one yarn to the yarn applicator at a first linear rate so that tufts formed by yarn supplied by the first yarn supplier has a first pile height; and a second yarn supplier for supplying a continuous length of at least one yarn to the yarn applicator at a second linear rate different then the first linear rate so that tufts formed by yarn supplied by the second yarn supplier has a second pile height different than the first pile height.

24. Apparatus as in claim 23 wherein the first yarn supplier supplies a plurality of continuous lengths of different yarns to the yarn applicator and the second yarn supplier supplies a plurality of continuous lengths of different yarns to the yarn applicator.

25. Apparatus as in claim 23 further comprising a control system for controlling the first and second yarn suppliers in accordance with a color pattern so as to select which of the continuous lengths of yarns, if any, is implanted in the backing at each penetration.

26. Apparatus as in claim 23 wherein the first yarn supplier is disposed along one side of the tufting frame and the second yarn supplier is disposed along an opposite side of the tufting frame.

27. Apparatus as in claim 23 wherein the yarn applicator comprises a plurality of hollow tufting needles.

28. Apparatus as in claim 23 wherein the first yarn supplier comprises a first geared drive shaft and a first motor capable of rotating the first geared drive shaft at a first speed and the second yarn supplier comprises a second geared drive shaft and a second motor capable of rotating the second geared drive shaft at a second speed different from the first speed.

29. Apparatus as in claim 23 wherein the backing transport system moves the backing transversely to the direction of advancement of the backing such that the yarn is implanted in the backing successively along a transverse row during transverse movement of the backing to form the plurality of yarn tufts.

30. Apparatus as in claim 23 further comprising a yarn cutter for selectively cutting the yarn implanted in the backing at each penetration.

31. Method for producing patterned tufted goods having differing pile heights comprising:

advancing a backing in a direction past a yarn applying region;

penetrating the backing with a reciprocating yarn applicator and implanting a yarn in the backing successively along a row during movement of the backing to form a plurality of yarn tufts in the backing;

supplying a continuous length of at least one yarn with a first yarn supplier to the yarn applicator at a first linear rate so that tufts formed by yarn supplied by the first yarn supplier has a first pile height; and supplying a continuous length of at least one yarn with a second yarn supplier to the yarn applicator at a second linear rate different then the first linear rate so that tufts formed by yarn supplied by the second yarn supplier has a second pile height different than the first pile height.

32. Method as in claim 31 wherein the first yarn supplier supplies a plurality of continuous lengths of different yarns to the yarn applicator and the second yarn supplier supplies a plurality of continuous lengths of different yarns to the yarn applicator.

33. Method as in claim 31 further comprising controlling the first and second yarn suppliers in accordance with a color pattern so as to select which of the continuous lengths of yarns, if any, is implanted in the backing at each penetration.

34. Method as in claim 31 wherein the yarn applicator comprises a plurality of hollow tufting needles.

35. Method as in claim 31 wherein the first yarn supplier comprises a first geared drive shaft, the second yarn supplier comprises a second geared drive shaft, the step of supplying yarn with the first yarn supplier includes rotating the first geared drive shaft at a first speed, and the step of supplying yarn with the second yarn supplier includes rotating the second geared drive shaft at a second speed different from the first speed.

36. Method as in claim 31 wherein the step of advancing the backing includes moving the backing transversely to the direction of advancement of the backing such that the yarn is implanted in the backing successively along a transverse row during transverse movement of the backing to form the plurality of yarn tufts.

37. Method as in claim 31 further comprising the step of selectively cutting the yarn implanted in the backing at each penetration.

38. Method for producing tufted goods comprising:

advancing a backing in a direction past a yarn applying region;

supplying a continuous length of yarn to a yarn applicator; and reciprocating a yarn applicator, which comprises a plurality of hollow tufting needles, between a top position above the backing and a bottom position below the backing such that the hollow tufting needles penetrate the backing and implant the yarn in the backing successively along a row during movement of the backing to form a plurality of yarn tufts in the backing, the hollow tufting needles traveling a displacement distance on each stroke from the backing to the bottom position and back to the backing when forming a tuft, wherein a length of the yarn is supplied on each stroke of the yarn applicator, the length of yarn being different than the displacement distance.

39. Method as in claim 38 wherein the step of supplying the yarn includes supplying a plurality of continuous lengths of different yarns to the yarn applicator, and the method further comprises controlling the supplying of the yarn in accordance with a color pattern so as to select which of the continuous lengths of yarns, if any, is implanted in the backing at each penetration so as to form a patterned tufted product.

40. Method as in claim 39 wherein the step of advancing the backing includes moving the backing transversely to the direction of advancement of the backing such that the yarn is implanted in the backing successively along a transverse row during transverse movement of the backing to form the plurality of yarn tufts.

41. Method as in claim 38 further comprising the step of selectively cutting the yarn implanted in the backing at each penetration.

42. Method as in claim 38 wherein the length of the yarn supplied on each stroke of the yarn applicator is less than the displacement distance so that the tufts are tight.

43. Method as in claim 38 wherein the length of the yarn supplied on each stroke of the yarn applicator is greater than the displacement distance so that the tufts are loose.

* * * * *